US006165010A

United States Patent [19]

Prazoff

[11] Patent Number: 6,165,010

[45] Date of Patent: Dec. 26, 2000

[54] DESKTOP EXTENSION POWER AND TELEPHONE PORT STATION

[76] Inventor: Michael Prazoff, 555 Chabanel St., West Ste #700, Montreal, Quebec, Canada, H2N-2J2

[21] Appl. No.: 09/417,431

[22] Filed: Oct. 13, 1999

[51] Int. Cl.[7] ..... H01R 13/60

[52] U.S. Cl. ..... 439/534; 362/421

[58] Field of Search ..... 439/534, 536, 439/6, 8, 535; 362/421, 395, 800

[56] References Cited

U.S. PATENT DOCUMENTS

| | | | |
|---|---|---|---|
| D. 389,459 | 1/1998 | Byrne | D13/143 |
| 1,514,133 | 11/1924 | Courson et al. | 362/421 |
| 2,165,531 | 7/1939 | Bertrand | 362/392 |
| 2,280,406 | 4/1942 | Gazin | 248/181 |
| 6,042,426 | 3/2000 | Byrne | 439/654 |

*Primary Examiner*—Paula Bradley
*Assistant Examiner*—Phuong Nguyen
*Attorney, Agent, or Firm*—Raymond Y. Chan; David and Raymond

[57] ABSTRACT

A desktop extension power and telephone port station includes a station body and a base. The station body defines a body chamber therein and the base includes a supporting shell that defines a shell chamber for receiving a weight member therein for stability. A light emitting diode (LED) indicator, a telephone notch, a fuse switch, and an electrical socket are arranged to mount on a front surface of the station body. An elongated telephone cord has a first end connected to the telephone notch mounted on the front shell and a second end connected to a telephone clip. An elongated electrical wire has a first end portion connected to the electrical socket, the fuse switch and the LED indicator and a second end portion connected to an electrical plug. The desktop extension power and telephone port station is adapted for providing a central location for connecting a telephone cord and a electrical cord of a notebook computer, coupled with a weight to keep the port station stable and not moving on the desktop, thus enabling a user to have a stable, fast, convenient and aesthetic unit for connecting and disconnecting her notebook computer.

20 Claims, 3 Drawing Sheets

DESKTOP EXTENSION POWER AND TELEPHONE PORT STATION

FIELD OF THE PRESENT INVENTION

The present invention relates to a desktop extension power and telephone port station which provides a single unit comprising a single station for connecting an electrical and telecommunications connections, coupled with a weight rendering the unit to rest on a desktop; thus providing an organized way of bundling the various cords so that the portable computer may be connected faster, and easier, with greater convenience for the user and with a much more aesthetic appearance.

BACKGROUND OF THE PRESENT INVENTION

The computer has evolved from a collection of machines filling a room, to an almost wafer thin notebook weighing no more than a few pounds. Today's economy is now a world economy. Business people travel worldwide handling customers all over the globe. At the same time, technological advances require more complex solutions, often requiring on the spot evaluations, plans and presentations. With these advances, the computer now plays a vital role. Today's society has been moving towards a portable computer, allowing not only a businessman, but students, retires, etc. to have instant access to complex programs, data or the internet by simply finding a telephone notch, and an electrical socket. An office can move wherever one can take her notebook computer.

But, the evolution of the computer has outpaced other changes in society. Offices and buildings cannot be restructured without great cost. They are not set up for every computer to have both a telephone line and an electrical cord in a central location. An electrical socket may be on one wall, while the telephone notch is on the opposite wall. The sockets may be located such that it is not possible to hook up both the telephone cord and the electrical cord. In many older buildings there may only be one electrical socket and one telephone notch in a room, at divergent locations. This becomes a greater issue for the user of a portable computer. As a result of a room infrastructure, the flexibility of being able to carry a portable computer wherever you go is hampered by the inflexibility of the infrastructures of the locations where the computer may be used. In addition, even if the cords can be attached, there may often be lines moving out in different directions from the notebook computer, interfering with desk space, creating a messy, cluttered appearance, and possibly hindering mobility within the room.

In the present market, there are no similar structures that extend and couple electrical socket and telephone notch into one aesthetic desktop station. There are conventional power strips with telephone notches, but these power strips are designed to sit in hidden areas, most likely behind desks, between wall and office furniture. They are not only aesthetically displeasing, but also because they are designed to be hidden, plugging in, and unplugging cords can be inconvenient for the user. Furthermore, because they lack a weight, as exists in the present invention, the power strip cannot be placed on the desk will not affect the balance of the power strip.

SUMMARY OF THE PRESENT INVENTION

A main object of the present invention is to create flexibility and aesthetics in an area where such flexibility did not exist. Using the present invention cords from an electrical socket and divergent telephone notch may be run along walls and out of sight, to meet in the present invention, a desktop extension power and telephone port station. Thus the user can simply set up his portable computer, and simply and easily hook up the computer, ready for work. A user merely needs to sit down, attach his telephone cord and electrical cord to the station, activate the station and/or the computer, and begin work. The individual is not required to search and struggle to find the best possible way attach her telephone and electrical cords without disrupting her workspace. Nor does the individual have to worry about the port station moving once she has plugged in the telephone and electrical cords. Similarly, the appearance on and around desktop remains neat, tidy and organized.

Another object of the present invention is to provide a desktop extension power and telephone port station for providing a central location for connecting a telephone cord and a electrical cord of a notebook computer, coupled with a weight to keep the port station stable and not moving on the desktop, thus enabling a user to have a stable, fast, convenient and aesthetic unit for connecting and disconnecting her notebook computer, without having to worry about cords connecting in different directions, a power strip that moves and may add to desktop clutter, bending or searching for sockets and telephone clips, or wasting time looking for sockets for the telephone and electrical cords. Another object of the present invention is to provide a port station that can also be used as a paperweight on the desktop.

Accordingly, in order accomplish the above objects, the present invention provides a desktop extension power and telephone port station, which comprises a housing for holding an electrical socket and a telephone socket, coupled with a base weight at the bottom of the housing. The housing comprises a station body having an outer front surface having openings for the electrical socket and the telephone socket. The surrounding inner walls of the station body define a body chamber. An telephone cord and an electrical wire are electrically connected to the telephone socket and the electrical socket respectively. The housing further comprises a base a base having a base weight attached thereon for supporting and stabilizing said station body on a desktop.

In other words, the housing can be separated into two distinct structures, the station body and the base, wherein said base further comprises a supporting shell for holding up said station body, fixedly attaching to the bottom of said station body by a station attaching means. A base bottom is affixedly attached to the rim of said supporting shell by a base attaching means.

A telephone cord and an electrical wire respectively connect to the telephone socket and the electrical socket on the inner surface of said station body, which are extend from the body chamber of the station body into a shell chamber of the base and exit through the supporting shell to connect with a telephone clip and an electrical plug respectively for connecting to the respective wall jack and socket.

It is also anticipated that the port station of the present invention may have a safety means, for turning the flow of electricity to the port station, on the front outer surface of the port station for turning on the electrical power for the port station on the outer surface. The electrical cord connects to said safety means inside the interior chamber of said station body and the safety means has another cord connecting to said electrical socket on the front inner surface of said station body. The safety means can be a switch, a fuse, or a circuit breaker.

Moreover, the port station may have an indicator light in conjunction, or without, a safety means for turning on said port station. The indicator light connects to the electrical cord, such that when the port station is plugged into a wall electrical socket and the port station is on, either from the direct connection, or if the port station holds a safety means and the safety means is in the "on" position, then the LED indicator lights up.

DETAILED DESCRIPTION OF THE PREFERRED EMBODIMENT

Figure 1:
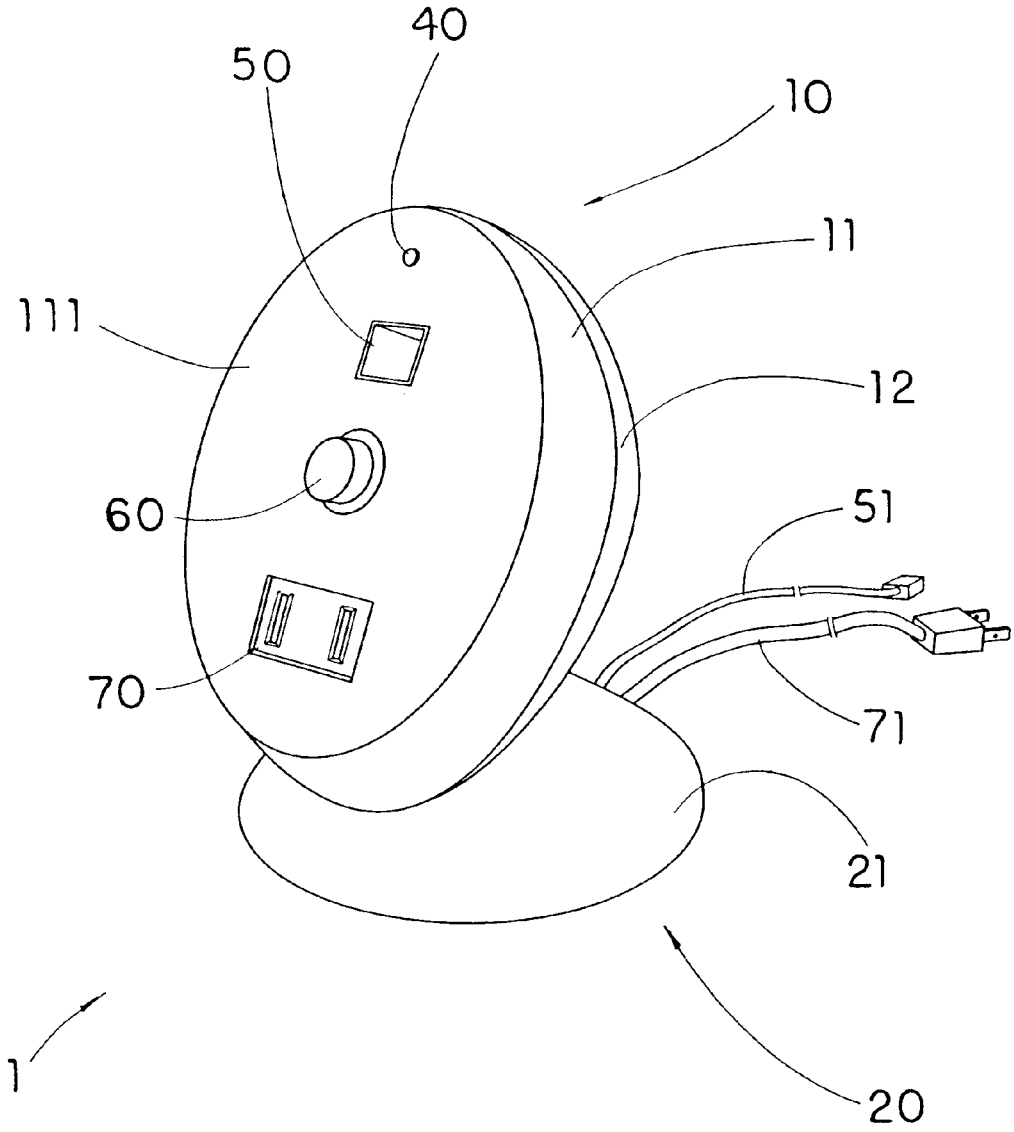
FIG. 1 is a perspective view of a desktop extension power and telephone port station according to a preferred embodiment for the present invention.
Figure 2:
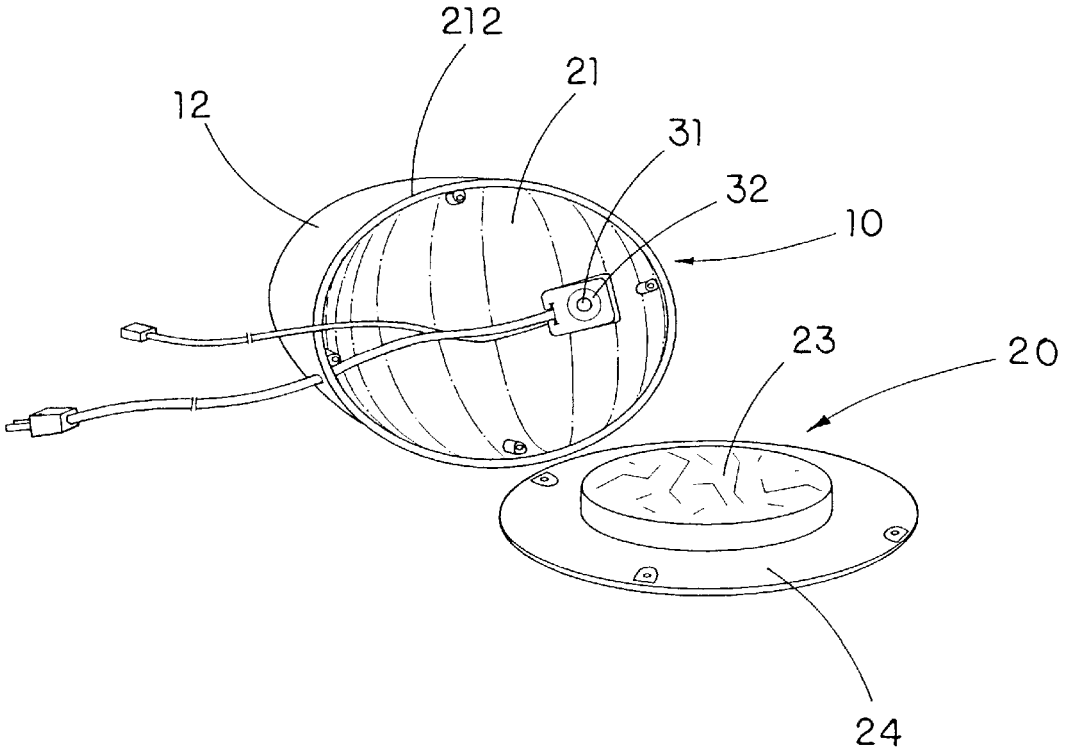
FIG. 2 is an exploded perspective view of the base and supporting shell of a desktop extension power and telephone port station according to the above preferred embodiment of the present invention.
Figure 3:
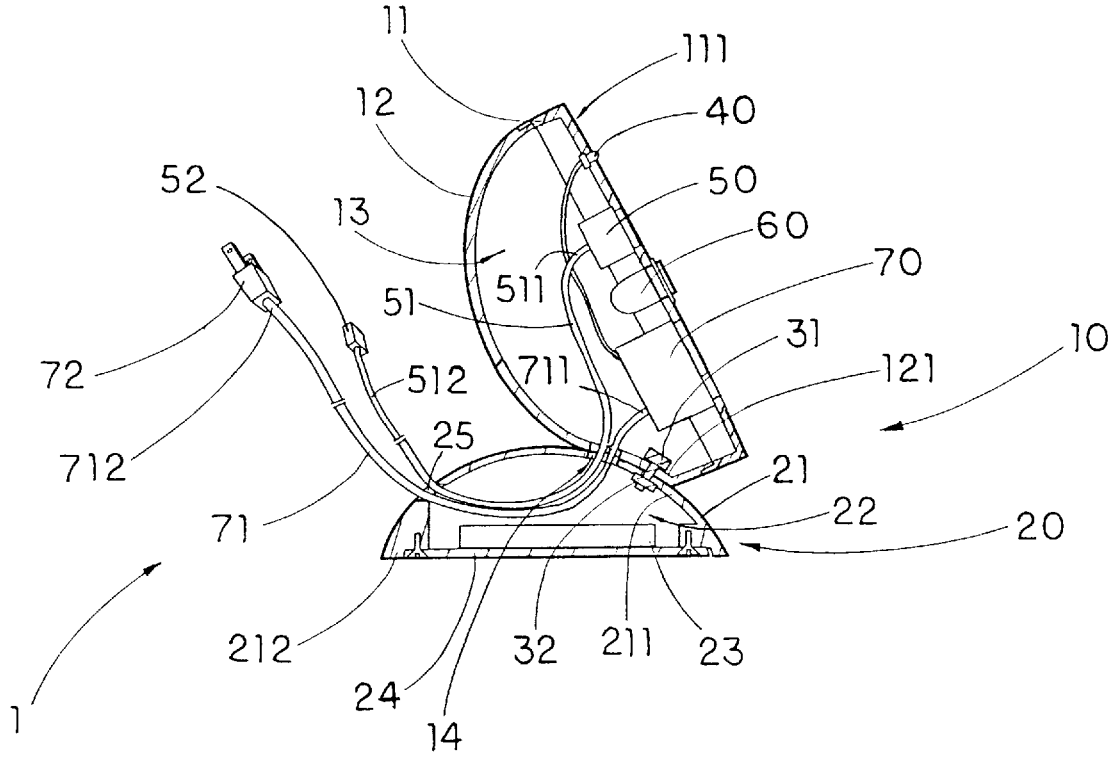
FIG. 3 is a sectional view of a desktop extension power and telephone port station according to the above preferred embodiment of the present invention.

Referring to FIGS. 1 to 3 of the drawings, a desktop extension power and telephone port station 1 according to a preferred embodiment of the present invention is illustrated, which comprises a station body 10 and a base 20. The station body 10 further comprises a flat front shell 11 affixedly connected with a curved rear shell 12 to define a body chamber 13 therein, as shown in FIG. 3. The base 20 comprises a supporting shell 21 that defines a shell chamber 22 for receiving a weight member 23 therein.

As shown in FIG. 3, a concave bottom portion 121 of the curved rear shell 12 of the station body 10 is affixed on the a convex top portion 211 of the supporting shell 21 by a bolt 31 and a nut 32. As shown in FIGS. 2 and 3, the base 20 further comprises a base plate 24 which is screwed to a bottom rim 212 of said supporting shell 21, wherein the weight member 23 is affixed on the base plate 24 so as to installed inside the shell chamber 22 in order to increase the total weight of the desktop extension power and telephone port station 1 of the present invention and provide stability for the port station 1 when the port station 1 rests on a desktop. Thereby, since the weight member 23 is placed at a lowest position of the desktop extension power and telephone port station 1, it can provide a steady effect of preventing it from turning over when pushing or pulling forces are applied to the station body 10.

As shown in FIGS. 1 and 3, a front surface 111 of the front shell 11 is arranged to mount thereon a light emitting diode (LED) indicator 40, a telephone socket 50, a fuse switch 60, and an electrical socket 70.

As shown in FIG. 3, an elongated telephone cord 51 has a first end 511 connected to the telephone notch 50 mounted on said front shell 11 and a second end 512 connected to a telephone clip 512 adapted for plugging into any wall telephone socket (not shown Figures). An elongated electrical wire 71 has a first end portion 711 connected to the electrical socket 70, the fuse switch 60 and the LED indicator 40 and a second end portion 712 connected to an electrical plug 72 adapted for plugging to a power supply such as any wall electrical socket (not shown in Figures), wherein the electrical socket 70, the fuse switch 60 and the LED indicator 40 are electrically connected in series, so that when the fuse switch 60 is switched on, the LED indicator 40 will light up to indicate that the electrical socket 70 is electrically powered on for the user to plug in the electrical plug of his or her notebook computer for electrical supply. Moreover, the phone clip extended from the notebook computer modem can be plugged into telephone notch 50 for communicating connection.

The fuse switch 60 further provides a fuse function to cut off the power supply when there is an electrical shock or circuit problem happened in the main power supply so as to protect the user's notebook computer. Alternatively, it is also anticipated that the port station of the present invention may have a safety means, for turning the flow of electricity to the port station, on the front outer surface of the port station for turning on the electrical power for the port station on the outer surface. The electrical cord connects to said safety means inside the interior chamber of said station body and the safety means has another cord connecting to said electrical socket on the front inner surface of the station body. The safety means can be a switch, a fuse, or a circuit breaker.

As shown in FIGS. 2 and 3, both the telephone cord 51 and the electrical wire 71 are extended from the body chamber 13 into the shell chamber 22 through a passage opening 14 provided therebetween. Then the telephone cord 51 and the electrical wire 71 together exit the shell chamber 22 through a wire exiting opening 25 provided at a rear bottom of the supporting shell 21 to connected with the telephone clip 52 and the electrical plug 72 respectively.

Figure 4:
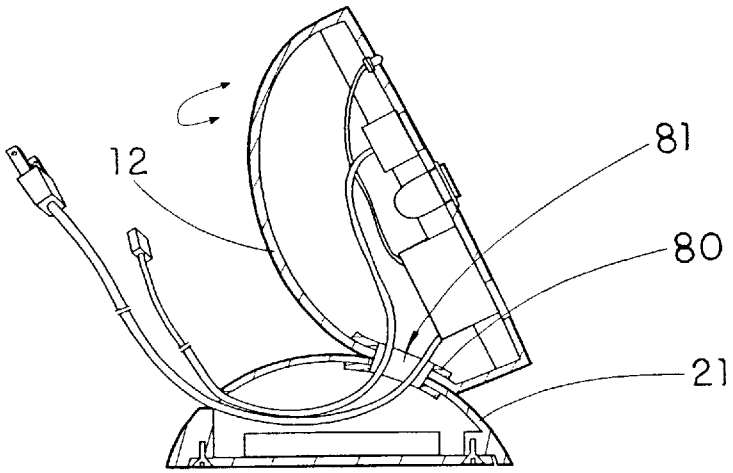
FIG. 4 is a sectional view of a desktop extension power and telephone port station according to an alternative mode of the above preferred embodiment of the present invention.

As shown in FIG. 4, an alternative mode of the above preferred embodiment is illustrated, wherein the bolt 31 and nut 32 are substituted by an engagement ring member 80 for rotatably connecting the bottom portion of the curved rear shell 12 and the top portion of the supporting shell 21 together while enabling the curved station body 10 to be freely rotated with respect to the base 20. Moreover, both the telephone cord 51 and electrical wire 71 are extended from the body chamber 13 into the shell chamber 22 through a central through hole 81 of the engagement ring member 80. Therefore, the station body 10 may swivel on said supporting shell 20 by rotating along the rotation axis created by the engagement ring member 80.

In view of above, the present invention creates flexibility and aesthetics in an area where such flexibility did not exist. Using the present invention cords from an electrical socket and divergent telephone notch may be run along walls and out of sight, to meet in the desktop extension power and telephone port station of the present invention. Thus the user can simply set up his portable computer, and simply and easily hook up the computer, ready for work. A user merely needs to sit down, attach his telephone cord and electrical cord to the station, activate the station and/or the computer, and begin work. The individual is not required to search and struggle to find the best possible way attach her telephone and electrical cords without disrupting her workspace. Nor does the individual have to worry about the port station moving once she has plugged in the telephone and electrical cords. Similarly, the appearance on and around desktop remains neat, tidy and organized.

Furthermore, the desktop extension power and telephone port station of the present invention also provides a central location for connecting a telephone cord and a electrical cord of a notebook computer, coupled with a weight to keep the port station stable and not moving on the desktop, thus enabling a user to have a stable, fast, convenient and aesthetic unit for connecting and disconnecting her notebook computer, without having to worry about cords connecting in different directions, a power strip that moves and may add to desktop clutter, bending or searching for sockets and telephone clips, or wasting time looking for sockets for the telephone and electrical cords. Another object of the present invention is to provide a port station that can also be used as a paperweight on the desktop.

What is claimed is:

1. A desktop extension power and telephone port station, comprising:

a station body which comprises a flat front shell affixedly connected with a curved rear shell to define a body chamber therein;

a base which comprises a supporting shell that defines a shell chamber for receiving a weight member therein, wherein a concave bottom portion of said curved rear shell of said station body is supported on a convex top portion of said supporting shell;

a light emitting diode (LED) indicator, a telephone socket, a fuse switch, and an electrical socket are mounted on a front surface of said front shell;

an elongated telephone cord having a first end connected to said telephone socket mounted on said front shell and a second end connected to a telephone clip; and an elongated electrical wire having a first end portion connected to said electrical socket, said fuse switch and said LED indicator and a second end portion connected to an electrical plug.

2. A desktop extension power and telephone port station, as recited in claim 1, wherein said electrical socket, said fuse switch and said LED indicator are electrically connected in series, so that when said fuse switch is switched on, said LED indicator lights up to indicate that said electrical socket is electrically powered on.

3. A desktop extension power and telephone port station, as recited in claim 1, wherein said base further comprises a base plate which is screwed to a bottom rim of said supporting shell, and a weight member is affixed on said base plate so as to be installed inside said shell chamber in order to increase said total weight of said desktop extension power and telephone port station.

4. A desktop extension power and telephone port station, as recited in claim 2, wherein said base further comprises a base plate which is screwed to a bottom rim of said supporting shell, and said weight member is affixed on said base plate so as to be installed inside said shell chamber in order to increase said total weight of said desktop extension power and telephone port station.

5. A desktop extension power and telephone port station, as recited in claim 1, wherein both said telephone cord and electrical wire are extended from said body chamber into said shell chamber through a passage opening provided therebetween, and then said telephone cord and said electrical wire together exit said shell chamber through a wire exiting opening provided at a rear bottom of said supporting shell to connect with said telephone clip and said electrical plug respectively.

6. A desktop extension power and telephone port station, as recited in claim 2, wherein both said telephone cord and electrical wire are extended from said body chamber into said shell chamber through a passage opening provided therebetween, and then said telephone cord and said electrical wire together exit said shell chamber through a wire exiting opening provided at a rear bottom of said supporting shell to connect with said telephone clip and said electrical plug respectively.

7. A desktop extension power and telephone port station, as recited in claim 3, wherein both said telephone cord and electrical wire are extended from said body chamber into said shell chamber through a passage opening provided therebetween, and then said telephone cord and said electrical wire together exit said shell chamber through a wire exiting opening provided at a rear bottom of said supporting shell to connect with said telephone clip and said electrical plug respectively.

8. A desktop extension power and telephone port station, as recited in claim 4, wherein both said telephone cord and electrical wire are extended from said body chamber into said shell chamber through a passage opening provided therebetween, and then said telephone cord and said electrical wire together exit said shell chamber through a wire exiting opening provided at a rear bottom of said supporting shell to connect with said telephone clip and said electrical plug respectively.

9. A desktop extension power and telephone port station, as recited in claim 5, wherein said concave bottom portion of said curved rear shell of said station body is affixed on said convex top portion of said supporting shell by a bolt and a nut.

10. A desktop extension power and telephone port station, as recited in claim 6, wherein said concave bottom portion of said curved rear shell of said station body is affixed on said convex top portion of said supporting shell by a bolt and a nut.

11. A desktop extension power and telephone port station, as recited in claim 7, wherein said concave bottom portion of said curved rear shell of said station body is affixed on said convex top portion of said supporting shell by a bolt and a nut.

12. A desktop extension power and telephone port station, as recited in claim 8, wherein said concave bottom portion of said curved rear shell of said station body is affixed on said convex top portion of said supporting shell by a bolt and a nut.

13. A desktop extension power and telephone port station, as recited in claim 1, further comprising an engagement ring member for rotatably connecting said bottom portion of said curved rear shell and said top portion of said supporting shell together while enabling said curved station body to be freely rotated with respect to said base, wherin both said telephone cord and said electrical wire are extended from said body chamber into said shell chamber through a central through hole of said engagement ring member, so that said station body is capable of swiveling on said supporting shell by rotating along a rotation axis created by said engagement ring member.

14. A desktop extension power and telephone port station, as recited in claim 2, further comprising an engagement ring member for rotatably connecting said bottom portion of said curved rear shell and said top portion of said supporting shell together while enabling said curved station body to be freely rotated with respect to said base, wherein both said telephone cord and said electrical wire are extended from said body chamber into said shell chamber through a central through hole of said engagement ring member, so that said station body is capable of swiveling on said supporting shell by rotating along a rotation axis created by said engagement ring member.

15. A desktop extension power and telephone port station, as recited in claim 3, further comprising an engagement ring member for rotatably connecting said bottom portion of said curved rear shell and said top portion of said supporting shell together while enabling said curved station body to be freely rotated with respect to said base, moreover both said telephone cord and said electrical wire are extended from said body chamber into said shell chamber through a central through hole of said engagement ring member, so that said station body is capable of swiveling on said supporting shell by rotating along a rotation axis created by said engagement ring member.

16. A desktop extension power and telephone port station, as recited in claim 4, further comprising an engagement ring member for rotatably connecting said bottom portion of said curved rear shell and said top portion of said supporting shell together while enabling said curved station body to be freely rotated with respect to said base, moreover both said telephone cord and said electrical wire are extended from said body chamber into said shell chamber through a central through hole of said engagement ring member, so that said station body is capable of swiveling on said supporting shell by rotating along a rotation axis created by said engagement ring member.

17. A desktop extension power and telephone port station, as recited in claim 13, wherein said telephone cord and said electrical wire together exit said shell chamber through a wire exiting opening provided at a rear bottom of said supporting shell to be connected with said telephone clip and said electrical plug respectively.

18. A desktop extension power and telephone port station, as recited in claim 14, wherein said telephone cord and said electrical wire together exit said shell chamber through a wire exiting opening provided at a rear bottom of said supporting shell to be connected with said telephone clip and said electrical plug respectively.

19. A desktop extension power and telephone port station, as recited in claim 15, wherein said telephone cord and said electrical wire together exit said shell chamber through a wire exiting opening provided at a rear bottom of said supporting shell to be connected with said telephone clip and said electrical plug respectively.

20. A desktop extension power and telephone port station, as recited in claim 16, wherein said telephone cord and said electrical wire together exit said shell chamber through a wire exiting opening provided at a rear bottom of said supporting shell to be connected with said telephone clip and said electrical plug respectively.

* * * * *